US009012794B2

(12) United States Patent
Hisada

(10) Patent No.: US 9,012,794 B2
(45) Date of Patent: Apr. 21, 2015

(54) OPERATING DEVICE

(75) Inventor: Masahito Hisada, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 292 days.

(21) Appl. No.: 13/432,318

(22) Filed: Mar. 28, 2012

(65) Prior Publication Data

US 2012/0247930 A1 Oct. 4, 2012

(30) Foreign Application Priority Data

Mar. 31, 2011 (JP) ..... 2011-078654

(51) Int. Cl.
*H01H 19/14* (2006.01)
*G05G 1/08* (2006.01)

(52) U.S. Cl.
CPC ..... *G05G 1/08* (2013.01)

(58) Field of Classification Search
CPC ..... H01H 19/585
USPC ..... 200/336, 564, 292, 4, 11
See application file for complete search history.

(56) References Cited

U.S. PATENT DOCUMENTS

| | | | | |
|---|---|---|---|---|
| 7,811,160 | B2 | 10/2010 | Ogawa et al. | |
| 2005/0098642 | A1 | 5/2005 | Ogawa et al. | |
| 2005/0224322 | A1* | 10/2005 | Kikuya et al. | 200/11 R |

FOREIGN PATENT DOCUMENTS

| | | | |
|---|---|---|---|
| CN | 101430981 | A | 5/2009 |
| CN | 101825914 | A | 9/2010 |
| EP | 1428699 | A1 | 6/2004 |
| GB | 2252814 | A | 8/1992 |
| JP | 2000-298527 | A | 10/2000 |
| JP | 2005-096579 | A | 4/2005 |
| JP | 2005-096582 | A | 4/2005 |
| JP | 2007-053062 | A | 3/2007 |

OTHER PUBLICATIONS

Office Action dated May 20, 2014, issued by the Japanese Patent Office in Japanese Patent Application No. 2011-078654.

Office Action dated Feb. 8, 2014, issued by the State Intellectual Property Office of China in Chinese Patent Application No. 201210078686.7.

* cited by examiner

*Primary Examiner* — Edwin A. Leon
*Assistant Examiner* — Ahmed Saeed
(74) *Attorney, Agent, or Firm* — Morgan, Lewis & Bockius LLP

(57) ABSTRACT

An operating device includes a dial member that has a first engaging portion provided on a peripheral portion thereof, a rotated body that has a hollow portion at a center portion thereof and a second engaging portion which is engaged with the first engaging portion of the dial member, the second engaging portion being provided on a peripheral portion of the rotated body, and an electric equipment member that is inserted into the hollow portion of the rotated body. A rotation of the dial member is transmitted to the rotated body through an engagement of the first engaging portion and the second engaging portion.

4 Claims, 4 Drawing Sheets

OPERATING DEVICE

BACKGROUND

The present invention relates to a dial type operating device.

In the related art, for example, there is an operating device shown in FIG. 4 as an operating device which is provided for an air conditioning operation of vehicles. In the operating device, from the left side in FIG. 4, a dial 1, an indication piece 2, a display panel 3, a panel support 4, a body 5, a push button 6, a light guiding piece 7, an intermediate gear 8, a switch 9, a LED 10, resistors 11 to 13, an insulator 14, a lamp 15, a final stage gear 16, a housing 17, and a pulley unit 18 are present in this order.

The dial 1 is formed in a hollow short cylindrical shape. The indication piece 2 is mounted on one place of an inner circumferential portion of the dial. The front end of the indication piece 2 is exposed forward from a recessed portion 19 of a leading edge of the dial 1. In addition, gear teeth 20 are formed in an inner circumferential portion of a rear portion of the dial 1.

The display panel 3 is formed in a circular sheet having a hole 21 in the center portion, in this case, a plurality of displays 22 which display a level of a set temperature in the interior of a cabin of a vehicle are annularly disposed in the front surface of the display panel 3, and the display panel 3 is attached to a front surface of the panel support 4. The panel support 4 is concentric with the hole 21 of the display panel 3 and includes a ring portion 23 which has substantially the same diameter as that of the hole 21.

The body 5 includes a large cylindrical portion 5*b* and a small cylindrical portion 5*c* which are concentrically disposed with respect to each other in the front of a polygonal box-shaped portion 5*a*. The panel support 4 is fixed to a leading edge of the small cylindrical portion 5*c*. The dial 1 is rotatably fitted to an outer circumference of the large cylindrical portion 5*b*. As result, the display panel 3 is exposed forward from an opening portion 1*a* of the front surface of the dial 1.

In this case, a display 24 of characters (NC) of an air conditioner and a light-transmitting window 25 are provided in the front surface of the push button 6. The light guiding piece 7 is inserted to a portion which extends to the light-transmitting window 25. The push button 6 is inserted from the small cylindrical portion 5*c* of the body 5 to the ring portion 23 of the panel support 4 and exposed forward from the hole 21 of the display panel 3.

The intermediate gear 8 includes gear teeth 8*a* in the front portion and gear teeth 8*b* in the rear portion. The gear teeth 8*a* of the front portion are inserted into a hole (not shown) which is formed in the lower portion of the polygonal box-shaped portion 5*a* of the body 5 and are meshed with the gear teeth 20 of the dial 1.

The switch 9, the LED 10, and the resistors 11 to 13 are mounted on the insulator 14, and the lamp 15 is also mounted on the insulator 14. Moreover, a notch 26 is formed in the lower portion of the insulator 14, the gear teeth 8*b* of the rear portion of the intermediate gear 8 are inserted into the notch 26, and therefore, the insulator 14 is combined with the body 5. In addition, a connector 27 is integrally formed in one place of the outer circumferential portion of the insulator 14, a mating connector (not shown) is connected to the connector 27, and the switch 9, the LED 10, the resistors 11 to 13, and the lamp 15 are electrically connected.

The final stage gear 16 is formed in a short cylindrical shape having a bottom, gear teeth 28 are formed in the inner circumferential portion of the gear 16, and the gear teeth 28 are meshed with the gear teeth 8*b* of the rear portion of the intermediate gear 8. In addition, a noncircular pulley shaft inserting hole 29 is formed in the center portion of the final stage gear 16.

The housing 17 accommodates the final stage gear 16 and is formed in a polygonal box shape which is combined with the polygonal box-shaped portion 5*a* of the body 5 while interposing the insulator 14, and a circular pulley shaft inserting hole 30 is formed in the center portion of the housing.

In the pulley unit 18, a pulley (not shown) which is a rotated body, is housed in a pulley case 18*a*. A noncircular hollow shaft 31 of the pulley is led out from the center portion of the pulley case 18*a* to the outside, and the pulley shaft 31 penetrates the pulley shaft inserting hole 30 of the housing 17 and is inserted into the pulley shaft inserting hole 29 of the final stage gear 16. In addition, the pulley unit 18 leads a cable 32, which is hung to the pulley, from one place of the circumference side portion of the pulley case 18*a* to the outside. In addition, a damper (not shown) for controlling temperature of air, which is supplied to the interior of a cabin of a vehicle is attached to the tip of the cable 32.

In the above configuration, if the dial 1 is gripped with a hand of an operator and is rotated, the rotation is transmitted from the gear teeth 20 to the gear teeth 8*a* of the front portion of the intermediate gear 8, and the rotation is transmitted from the gear teeth 8*b* of the rear portion of the intermediate gear 8 to the gear teeth 28 of the final stage gear 16. Therefore, the final stage gear 16 is rotated, and the pulley (not shown) is rotated through a noncircular engagement portion of the pulley shaft inserting hole 29 of the final stage gear 16 and the pulley shaft 31 of the pulley unit 18. Thereby, the cable 32 is wound, the damper (not shown) attached to the tip of the cable 32 is operated, and the temperature of the air which is supplied to the interior of the cabin of the vehicle is adjusted.

In addition, the display 22 of the display panel 3 displays the adjusted temperature, and the indication piece 2 indicates a position (corresponding to the rotation angle of the dial 1) of the display 22 of the display panel 3, that is, a set temperature position according to the rotation of the dial 1. Moreover, at this time, the lamp 15 illuminates the entire display 22 from the rear side of the display. Accordingly, the display 22 has light transmissivity.

In addition, if the push button 6 is pressed with a fingertip of an operator, the switch 9 which is mounted on the insulator 14 is pressed and operated, and the air conditioner is operated. Moreover, the LED 10 emits light, and the light transmits the light guiding piece 7, emerges in the light-transmitting window 25 of the push button 6, and displays the operation of the air conditioner (for example, refer to Patent Document 1).

[Patent Document 1] JP-A-2005-96579

In the configuration of the related art, operation of the dial 1 is transmitted to the pulley, which is the rotated body of the pulley unit 18, through engagements of the gear teeth in several stages, and a backlash inevitably exists in each of the engagements of the gear teeth of each stage. Therefore, the operation of the pulley cannot be directly performed by the dial 1 due to each backlash and operation feeling is deteriorated. In addition, due to the fact that the operation undergoes the engagements of the gear teeth in several stages, size of the device is increased, and the costs are also increased. Moreover, the final stage gear 16 to which the rotating force is transmitted from the gear teeth 8*b* of the rear portion of the intermediate gear 8 includes the gear teeth 28, which is meshed with the gear teeth 8*b*, in the inner circumferential portion, and the center portion of the final stage gear is connected to the pulley shaft 31. Therefore, from this relationship, in the insulator 14 which is an electric equipment member, the connector 27 is provided on the outer circumferential portion of the insulator 14 other than the center portion of the insulator 14; accordingly, there is a disadvantage in that size of the device is increased.

SUMMARY

The present invention is made in consideration of the above-described problems, and an object thereof is to provide an operating device capable of achieving improvement of operation feeling, decrease in size of the operating device, and decrease in the costs.

In order to achieve the object, there is provided an operating device comprising:

a dial member that has a first engaging portion provided on a peripheral portion thereof;

a rotated body that has a hollow portion at a center portion thereof and a second engaging portion which is engaged with the first engaging portion of the dial member, the second engaging portion being provided on a peripheral portion of the rotated body; and an electric equipment member that is inserted into the hollow portion of the rotated body, wherein a rotation of the dial member is transmitted to the rotated body through an engagement of the first engaging portion and the second engaging portion.

According to the configuration, since operation of the dial member is directly transmitted to the rotated body through the engagement of the first engaging portion of the dial member and the second engagement portion of the rotated body, a disadvantage due to a backlash through engagements of gears in a plurality of stages in the related art is not generated, and operational feeling can be improved. In addition, since the gears in the related art can be removed, a size of the entire operating device can be decreased, and the cost can be decreased. Moreover, since the gears are removed, the first engaging portion of the dial member and the second engaging portion of the rotated body are provided in the peripheral portions of each of the dial member and the rotated body, and the rotated body having the hollow portion can be used. In addition, since the electric equipment member is provided so as to insert into the hollow portion of the rotated body, the electric equipment member can be disposed in the center portion of the operating device, and a size of the entire device can be further decreased.

Preferably, the first engaging portion is one of an engagement protrusion and an engagement hole, and the second engaging portion is the other of the engagement protrusion and the engagement hole.

Preferably, the dial member includes a dial having a first retaining portion and a rotor having a second retaining portion which is retained to the first retaining portion, and the rotor has the first engaging portion.

Preferably, the electric equipment member includes a housing having a metal pin, and an electric circuit connected to the metal pin.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1:
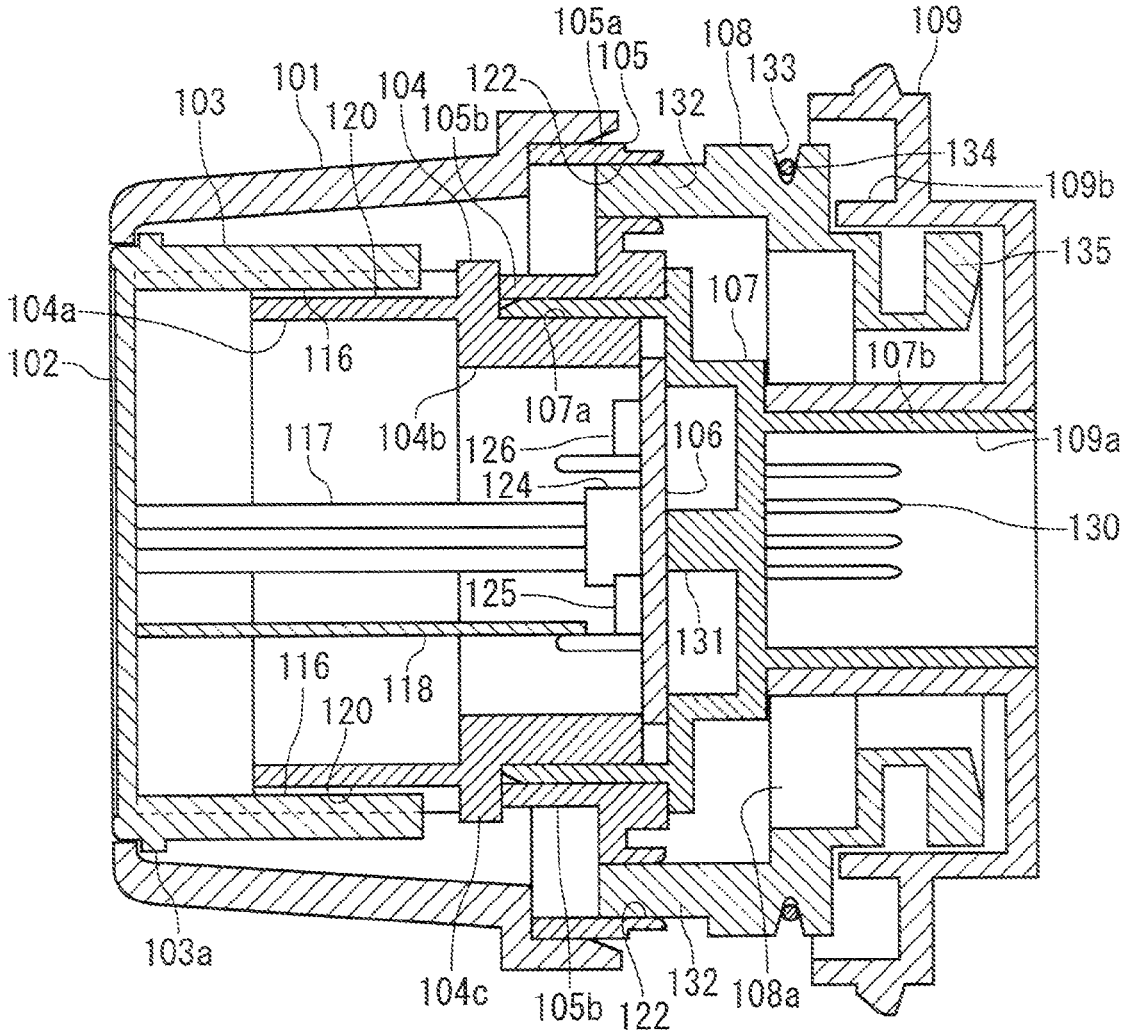
FIG. 1 is a longitudinally sectional view showing an operating device according to an embodiment of the present invention.

Hereinafter, an example (an embodiment) of the present invention will be described with reference to FIGS. 1 to 3.

Figure 3:
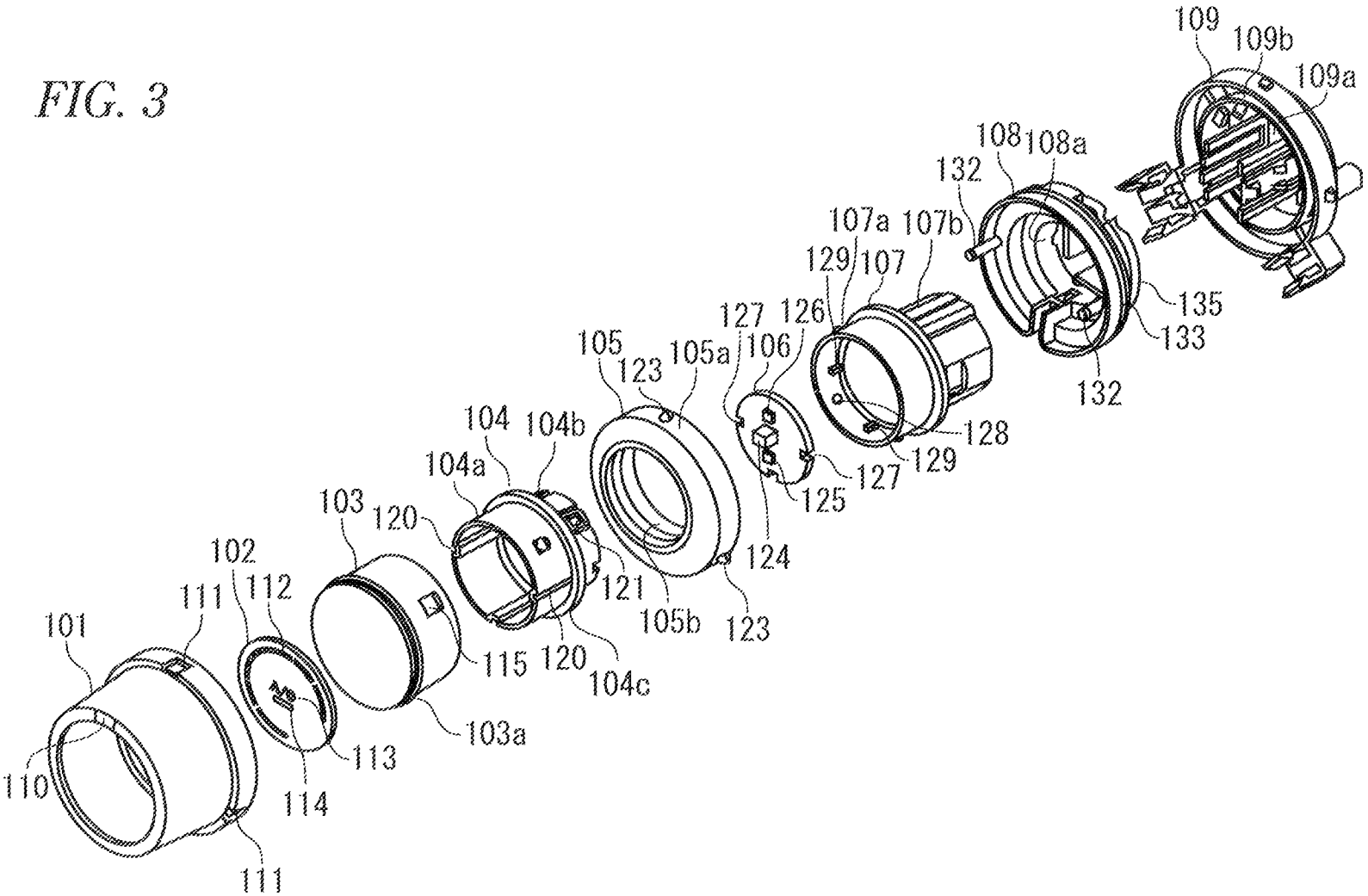
FIG. 3 is an exploded perspective view of the operating device according to the embodiment.
Figure 4:
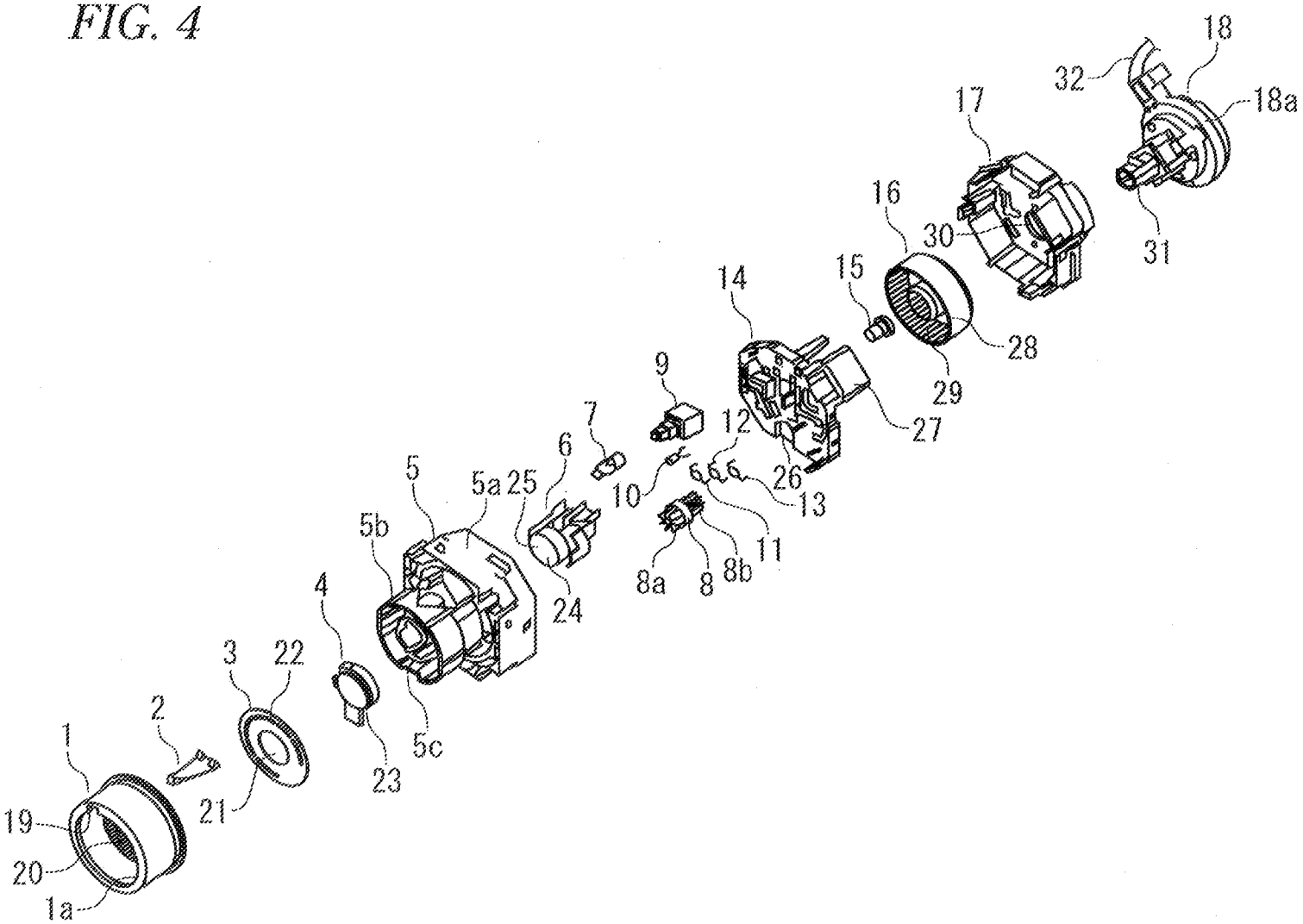
FIG. 4 is an exploded perspective view equivalent to FIG. 3 showing an example of an operating device in the related art.

First, FIG. 3 shows a state where the entire operating device is exploded, and the operating device is provided so as to perform temperature adjusting operation in the interior of vehicles in air conditioning operation for vehicles, particularly for automobiles. From the left side of FIG. 3, a dial 101, a display panel 102, a push button 103, a body 104, a rotor 105, a circuit board 106, a housing 107, a pulley 108, and a pulley casing 109 are shown in the order.

Among these, the dial 101 is formed in a hollow short cylindrical shape, and includes a display portion 110 in one place of a leading edge portion of the dial. The dial 101 also includes engagement holes 111 in a plurality of places of an edge portion having large diameter in the rear end of the dial.

Figure 2:
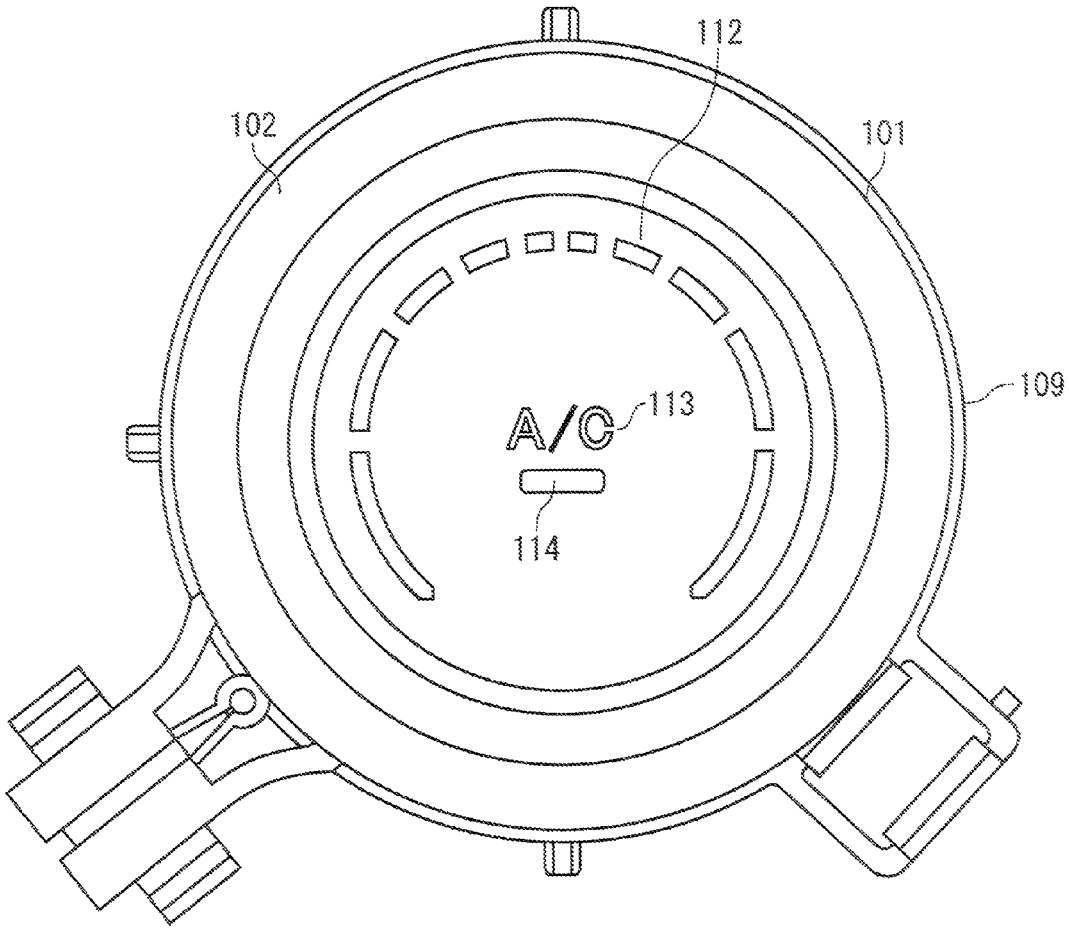
FIG. 2 is a front view of the operating device according to the embodiment.

The display panel 102 is formed in a circular sheet, in the case, as shown in detail in FIG. 2, a plurality of displays 112 is provided so as to be annually disposed in the peripheral portion of the front surface of the display panel. The displays 112 display a level of a set temperature in the interior of the cabin and have light transmissivity. A display 113 of characters (NC) of an air conditioner and a light-transmitting window 114 are provided in the center portion of the display panel.

The push button 103 is configured by a light transmissive material and is formed in a short cylindrical shape having a cover. Also, the push button 103 includes a flange portion 103*a* provided in the front portion of the circumference side portion of the push button, and connection holes 115 provided in a plurality of places (only one place is shown) rearward from the flange portion. In addition, as shown in FIG. 1, protrusions 116 extending in forward and backward directions which are an axial direction are provided in a plurality of places of the inner circumferential portion of the push button 103, and a switch operating protrusion 117 and a light shielding wall 118 are provided in the center portion of the push button.

The body 104 includes a large cylindrical portion 104*a* in the front portion and a small cylindrical portion 104*b* in the rear portion. In addition, the body 104 includes a flange portion 104*c* in the outer circumference of the boundary between the cylinder portions 104*a* and 104*b*. Connection protrusions 119 corresponding to the connection holes 115 of the push button 103 and recessed streaks 120 corresponding to the protrusions 116 are provided in the outer circumferential portion of the large cylindrical portion 104*a*. Moreover, the lengths of the connection holes 115 of the push button 103 are longer in the forward and backward directions than those of connection protrusions 119. In addition, connection holes 121 are provided in a plurality of places (only one place is shown) of the small cylindrical portion 104*b* of the body 104.

The rotor 105 is formed in a ring shape and includes an outer annular portion 105*a* and an inner annular portion 105*b*. As shown in FIG. 1, the rotor includes engagement holes 122 which are engaging portions provided in a plurality of places (in this case, two places) between both annular portions 105*a* and 105*b*. Moreover, as shown in FIG. 3, engagement protrusions 123 corresponding to the engagement holes 111 of the dial 101 are provided in the outer circumference of the outer annular portion 105*a* of the rotor 105.

The circuit board 106 is formed in a disk shape, a switch (for example, duct switch) 124 is mounted on the center portion in the front surface of the circuit board, and a light emitter (for example, LED) 125 corresponding to the light-transmitting window 114 of the display panel 102 and a light emitter (for example, LED) 126 corresponding to the display 112 are mounted on the periphery of the circuit board. Moreover, fitting recesses 127 are provided in a plurality of places of the outer circumferential portion of the circuit board 106.

The housing 107 includes a cylindrical portion 107*a* in the front portion and a square cylindrical portion 107*b* in the rear portion. Connection protrusions 128 corresponding to the connection holes 121 of the body 104 and fitting protrusions 129 corresponding to the fitting recesses 127 of the circuit board 106 are provided in the inner circumferential portion of the cylindrical portion 107*a*. In addition, as shown in FIG. 1, connection terminals 130 in the required number are provided in the inner portion of the square cylindrical portion 107*b* of the housing 107, and a connecting portion 131 which houses a connecting conductor (not shown) provided to be electrically connected to the circuit board 106 is provided. The connection terminals 130 are connected so as to fit to female side connection terminals of a mating connector (not shown).

The pulley 108 is formed in a ring shape having the substantially same size as the rotor 105, in brief, the pulley is formed in a hollow shape including a cavity 108*a* in the inner portion. Engagement protrusions 132, which are bodies to be engaged, corresponding to the engagement holes 122 of the rotor 105 are provided in the peripheral portion of the front portion of the pulley. Moreover, the pulley 108 includes a cable hook groove 133 in the outer circumferential portion, and a cable 134 shown in FIG. 1 is hung to the cable hook groove 133. In addition, the pulley 108 includes a connecting portion 135, which is provided so as to connect to a cable case 109 described below, in the rear portion.

The pulley case 109 is formed in a ring shape which is larger than the pulley 108, in brief, the pulley case is also formed in a hollow shape having a cavity 109*a* in the inner portion. The pulley case includes an annular pulley support portion 109*b* which is provided in the intermediate portion between the cavity 109*a* and the outer circumferential portion.

In the configuration described above, as shown in FIG. 1, the display panel 102 is bonded to the front surface of the push button 103, and the push button 103 is inserted into the dial 101. Next, the body 104 is inserted into the dial 101, the recessed streaks 120 of the body 104 are fitted to the protrusions 116 of the push button 103, and the large cylindrical portion 104*a* is inserted into the push button 103. Moreover, at this time, the connection protrusions 119 of the body 104 are engaged with the connection holes 115 of the push button 103, and rotation of the push button 103 and the display panel 102 is stopped.

On the other hand, the circuit board 106 is inserted into the cylindrical portion 107*a* of the housing 107 and the fitting recesses 127 of the circuit board 106 are fitted to the fitting protrusions 129. Therefore, the circuit board 106 is mounted on the housing 107 and the rotation of the circuit board is stopped. At this time, the switch 124 and the light emitters 125 and 126 which are mounted on the circuit board 106 are connected to the connecting terminal 130 by the connecting portion 131 of the housing 107. Accordingly, the circuit board 106 and the housing 107 are electric equipment members.

The rotor 105 is fitted to the cylindrical portion 107*a* of the housing 107, and the cylindrical portion 107*a* of the housing 107 is fitted to the small cylindrical portion 104*b* of the body 104. Therefore, the connection protrusions 128 are engaged with the connection holes 121 of the body 104 and the rotation of the housing is stopped. Moreover, the rotor 105 is inserted into the rear portion of the dial 101 and the engagement protrusions 123 are engaged with the engagement holes 111 of the dial 101. As a result, the engaging portions (engagement holes 122) are configured so as to be provided in the peripheral portion of the dial 101.

In addition, the pulley support portion 109*b* of the pulley case 109 is fitted to the connecting portion 135 of the pulley 108 and the cavity 109*a* of the pulley case 109 is fitted to the square cylindrical portion 107*b* of the housing 107. Therefore, the electric equipment member (housing 107) is inserted into the cavity 109*a* of the pulley case 109 and the cavity 108*a* of the pulley 108.

Moreover, the engagement protrusions 132 of the pulley 108 are engaged so as to be inserted into the engagement holes 122 of the rotor 105.

In addition, although not shown, the cable 134 which is hung to the pulley 108 is led from the cable case 109 and a damper (not shown) for adjusting temperature of air which is supplied to the interior of a cabin of a vehicle is attached to the tip of the cable.

In the case of being configured as described above, if the dial 101 is gripped with a hand of an operator and is rotated so as to display any one of displays 112 of the display panel 102 through the display portion 110, the rotor 105 is rotated via the engagement of the engagement holes 111 of the dial 101 and the engagement protrusion 123 of the rotor 105, the pulley 108 is rotated via the engagement of the engagement holes 122 (first engaging portions which are provided in the peripheral portion of the dial 101) of the rotor 105 and the engagement protrusions 132 (second engaging portions) of the pulley 108, and therefore, the rotation of the dial 101 is transmitted to the pulley 108. Accordingly, the pulley 108 is a rotated body to which the rotation of the dial 101 is transmitted, due to the fact that the pulley 108 which is the rotated body is rotated, the cable 134 is wound, the damper (not shown) attached to the tip of the cable 134 is operated, and the temperature of the air which is supplied to the interior of the cabin of a vehicle is set. The display 112 is illuminated by the light emitter 126.

In addition, if the push button 103 is operated so as to be pressed from the front surface of the display panel 102, the push button 103 moves backward while the protrusions 116 are guided to the recessed streaks 120 of the body 104, and the switch 124 in the front surface of the circuit board 106 is pressed by the switch operating protrusion 117 according to the movement, the air conditioner (not shown) is operated. Moreover, at this time, the light emitter 125 emits light, and the light transmits the light-transmitting window 114 of the display panel 102 from the front wall having light transmissivity of the push button 103 and emerges in the front surface of the window, and displays the operation of the air conditioner. In addition, if the pressing operating of the push button 103 is released, the push button 103 is returned by restoring force of the switch 124.

According to the operating device having the configuration as described above, since the operation of the dial 101 is directly transmitted to the pulley 108 via the engagement of the engagement holes 122 serving as the engaging portions of the dial 101 and the engagement protrusions 132 which are the engaging portions of the pulley 108 (rotated body), unlike the configuration in the related art which is through engagements of gears in a plurality of stages, a disadvantage due to backlash is not generated, and operational feeling can be improved. In addition, since the gears in the related art can be removed, a size of the entire device can be decreased, and the cost can be decreased. Moreover, since the gears are removed, the engagement holes 122 of the dial 101 and the engagement protrusions 132 of the pulley 108 are provided in the peripheral portions of each of the dial 101 and the pulley 108, and the pulley 108 having the hollow portion can be used. In addition, since the square cylindrical portion 107*b* (electric equipment member) of the housing 107 is provided so as to insert into the cavity 108*a*, the square cylindrical portion 107*b* of the housing 107 can be disposed in the center portion of the device, and a size of the entire device can be further decreased.

Moreover, the engaging portions of the dial 101 are not limited to the engagement holes 122. The engaging portions of the dial 101 may be changed to the engagement protrusions 132. Corresponding to the above, the engaging portion of the pulley 108 (rotated body) is not limited to the engagement protrusions 132. The engaging portion of the pulley 108 may be changed to the engagement holes 122. In addition, the engaging portions 12 of the dial 101 may be embodied so as to be directly provided on the dial 101. Moreover, the rotated body is not limited to the pulley 108. The rotated body may be embodied so as to be changed to a member other than the pulley 108. In addition, the push button 103 may be embodied so as to be not provided.

Moreover, the present invention is not limited to the embodiments described above and shown in the drawings, and may be embodied so as to be appropriately modified within the scope which does not depart from the gist.

The present application is based on Japanese Patent Application No. 2011-078654 filed on Mar. 31, 2011, the contents of which are incorporated herein by reference.

What is claimed is:

1. An operating device comprising:

a dial member that has a first engaging portion provided on a peripheral portion thereof;

a rotated body that has a hollow portion at a center portion thereof and a second engaging portion which is engaged with the first engaging portion of the dial member, the second engaging portion being provided on a peripheral portion of the rotated body; and an electric equipment member that is inserted into the hollow portion of the rotated body, and includes:

a housing having a metal pin; and an electric circuit connected to the metal pin, wherein the metal pin is provided in an inner portion of a cylindrical portion of the housing;

the cylindrical portion of the housing is located at the hollow portion of the rotated body;

the cylindrical portion of the housing and the metal pin are configured as a connector to be fit to a mating connector having a connecting terminal to be connected to the metal pin; and a rotation of the dial member is transmitted to the rotated body through an engagement of the first engaging portion and the second engaging portion.

2. The operating device according to claim 1, wherein the first engaging portion is one of an engagement protrusion and an engagement hole; and wherein the second engaging portion is the other of the engagement protrusion and the engagement hole.

3. The operating device according to claim 1, wherein the dial member includes:

a dial having a first retaining portion; and a rotor having a second retaining portion which is retained to the first retaining portion; and wherein the first engaging portion is disposed on the rotor of the dial member.

4. The operating device according to claim 1, wherein the rotated body includes a cable hook groove in an outer circumferential portion of the rotated boy, a cable being hung to the cable hook groove and wound by the rotation of the rotated body.

* * * * *